US007218284B2

(12) United States Patent
Aizawa et al.

(10) Patent No.: US 7,218,284 B2
(45) Date of Patent: May 15, 2007

(54) ANTENNA UNIT

(75) Inventors: Toshiaki Aizawa, Akita (JP); Junichi Noro, Akita (JP); Kyuichi Sato, Akita (JP); Yuichi Saito, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 11/043,056

(22) Filed: Jan. 27, 2005

(65) Prior Publication Data

US 2005/0225489 A1 Oct. 13, 2005

(30) Foreign Application Priority Data

Apr. 9, 2004 (JP) ..... 2004-114972

(51) Int. Cl.
*H01Q 1/32* (2006.01)

(52) U.S. Cl. ..... 343/713; 343/711; 343/872

(58) Field of Classification Search ..... 343/713, 343/711, 872, 712, 700 MS, 841
See application file for complete search history.

(56) References Cited

U.S. PATENT DOCUMENTS 4,931,805 A * 6/1990 Fisher ..... 343/715
5,742,255 A * 4/1998 Afendras ..... 343/713
5,757,327 A * 5/1998 Yajima et al. ..... 343/713
5,805,113 A * 9/1998 Ogino et al. ..... 343/713
5,886,674 A * 3/1999 Yoshimi ..... 343/882
5,900,840 A * 5/1999 Yajima ..... 343/713
6,999,032 B2 2/2006 Pakray et al.
7,002,523 B2 * 2/2006 Noro ..... 343/713
7,071,885 B2 * 7/2006 Noro et al. ..... 343/713

FOREIGN PATENT DOCUMENTS

JP 8-84207 8/1996

* cited by examiner

*Primary Examiner*—Hoang V. Nguyen
(74) *Attorney, Agent, or Firm*—Whitham, Curtis, Christofferson & Cook, P.C.

(57) ABSTRACT

An antenna unit includes an antenna module that receives radio waves sent from a satellite or earth, a cover member that has enough inner space to house the antenna module and has an opened bottom surface, and a bottom plate that closes the opened bottom surface of the cover member, and the antenna unit is attached to a resin-made attachment part. A metal sheet is provided on a back surface side of the resin-made attachment part, and the antenna unit is adhesive bonded and fixed on a surface side of the resin-made attachment part correspondingly to an arrangement position of the metal sheet.

5 Claims, 2 Drawing Sheets

ANTENNA UNIT

BACKGROUND OF THE INVENTION

1. Filed of the Invention

The present invention relates to an attachment structure of an antenna unit that receives radio waves sent from, for example, a satellite onto a vehicle. Particularly, the invention relates to improvement of an attachment structure onto a plastic attachment part.

2. Description of the Related Art

Heretofore, a system which navigates a car route for a driver of an automobile, that is, a car navigation system, has been widely applied. In such a car navigation system, a present position is specified according to speed and running distance of a car. In order to improve positional accuracy, radio waves that include position data are sent from a GPS satellite to the car navigation system.

Alternatively, the USA has recently begun providing digital radio broadcasting with use of radio waves sent from an artificial satellite. For a digital radio reception system that receives digital radio broadcasting, an antenna is necessary for receiving radio waves sent from the satellite, and a so-called satellite radio antenna has been used.

Since the radio wave from the satellite uses a high-frequency band, the satellite has high directivity. Therefore, for the car navigation system and the digital radio reception system, it is necessary to attach a reception antenna on an upper surface (that is, a roof or trunk) of a car in order to have good reception when radio waves are received.

When attaching the antenna unit, method of boring a hole in, for example, a vehicle roof to mount the antenna unit and fixing with a nut and bolt has been widely applied. If the roof is a metal plate, a waterproof countermeasure is taken by interposing a rubber gasket between a vehicle roof and an antenna base.

For instance, the example of the related art includes JP-A-8-84207.

In a vehicle such as automobile, weight reduction has been advanced, so that plastic members are used in a roof, a bonnet, trunk, and the like.

If the above-mentioned antenna unit is attached onto such plastic members, a problem of ground (GND) occurs. Using the satellite radio antenna as an example, if an antenna having GND dependency, such as a patch antenna, a loop antenna or the like, is mounted on the vehicle, it utilizes a roof or a trunk that is composed of metal as a ground (GND) plate. However, if the roof or trunk is composed of plastic, the ground of the antenna cannot be secured.

In order to solve this problem, a progressive wave type antenna or an antenna that includes a ground plate is used so that the ground can be secured by the antenna itself. However, these prior methods result in significant increases in the height and area of the antenna, so that these antennas are not preferable in appearance. Further, these antennas are expensive, so that they are disadvantageous also from a viewpoint of cost.

Further, there are problems in the prior attachment methods. If the antenna unit is attached onto the roof or trunk composed of a metal plate, a method of boring a hole in the roof or trunk, mounting the antenna unit in this hole, and fixing the antenna unit with a bolt and a nut has been applied. If the material of the roof or trunk is plastic (resin), the material cannot correspond to bolt tightening power in the bolt type method.

SUMMARY OF THE INVENTION

The invention has been proposed in order to solve these conventional disadvantages. Namely, an object of the invention is to provide an attachment structure of an antenna unit, in which ground can be secured if the antenna unit is set on a plastic attachment part. Furthermore, the height and the area of the antenna unit do not need to be enlarged, and an expensive antenna unit is not required. Another object of the invention is to provide an attachment structure of an antenna unit that corresponds to a plastic roof or trunk by providing a new method of fixing the antenna unit alternative to a bolt type fixing method.

In order to achieve the above objects, an antenna unit of the invention, which includes an antenna module that receives radio waves sent from a satellite or earth, a cover member that has enough inner space to house the antenna module and has an opened bottom surface, and a bottom plate that closes the opened bottom surface of the cover member, and which is attached to a resin-made attachment part provided for a moving body, is characterized in that a metal sheet is provided on a back surface side of the resin-made attachment part, and the antenna unit body is adhesively bonded and fixed on a surface side of the resin-made attachment part correspondingly to an arrangement position of the metal sheet.

In the attachment structure of the antenna unit of the invention, the metal sheet provided on the back surface side of the attachment part plays a role of ground (GND) thereby to secure the ground of the antenna. Accordingly, as the antenna unit itself, the same type as that used in a metal attachment part can be used, so that it is not necessary to prepare a progressive wave type (helical type) or a self ground type antenna unit.

Further, it is difficult for a bolt type fixing to correspond to a plastic attachment part. Therefore, in the invention, in place of the bolt type, bonding and setting with double-sided tape is performed. Since the bolt tightening power is not applied to the attachment part in the invention, this bonding and setting with double-sided tape can correspond also to the plastic attachment part. Further, since the double-sided tape is arranged so as to compensate a gap between the attachment part and the antenna unit completely, waterproofing can be also achieved.

According to the invention, if the antenna unit is set on the plastic attachment part, ground can be secured. Accordingly, the progressive wave type (helical type) or the self ground type antenna unit is not necessary, and the height and area of the antenna unit are not enlarged, so that the antenna of the invention is advantageous in its appearance. Further, since the expensive antenna is not also necessary, the antenna of the invention is advantageous also in cost.

Further, according to the invention, a secure mounting method can be achieved when the traditional bolt and nut method cannot be used. Namely, the antenna unit can be surely fixed to the plastic attachment part. Further, simultaneously, waterproofing can be secured.

DESCRIPTION OF THE PREFERRED EMBODIMENTS

Regarding an antenna unit to which the invention is applied, attachment of a satellite radio reception antenna onto an automotive roof will be described below as an example.

Figure 1:
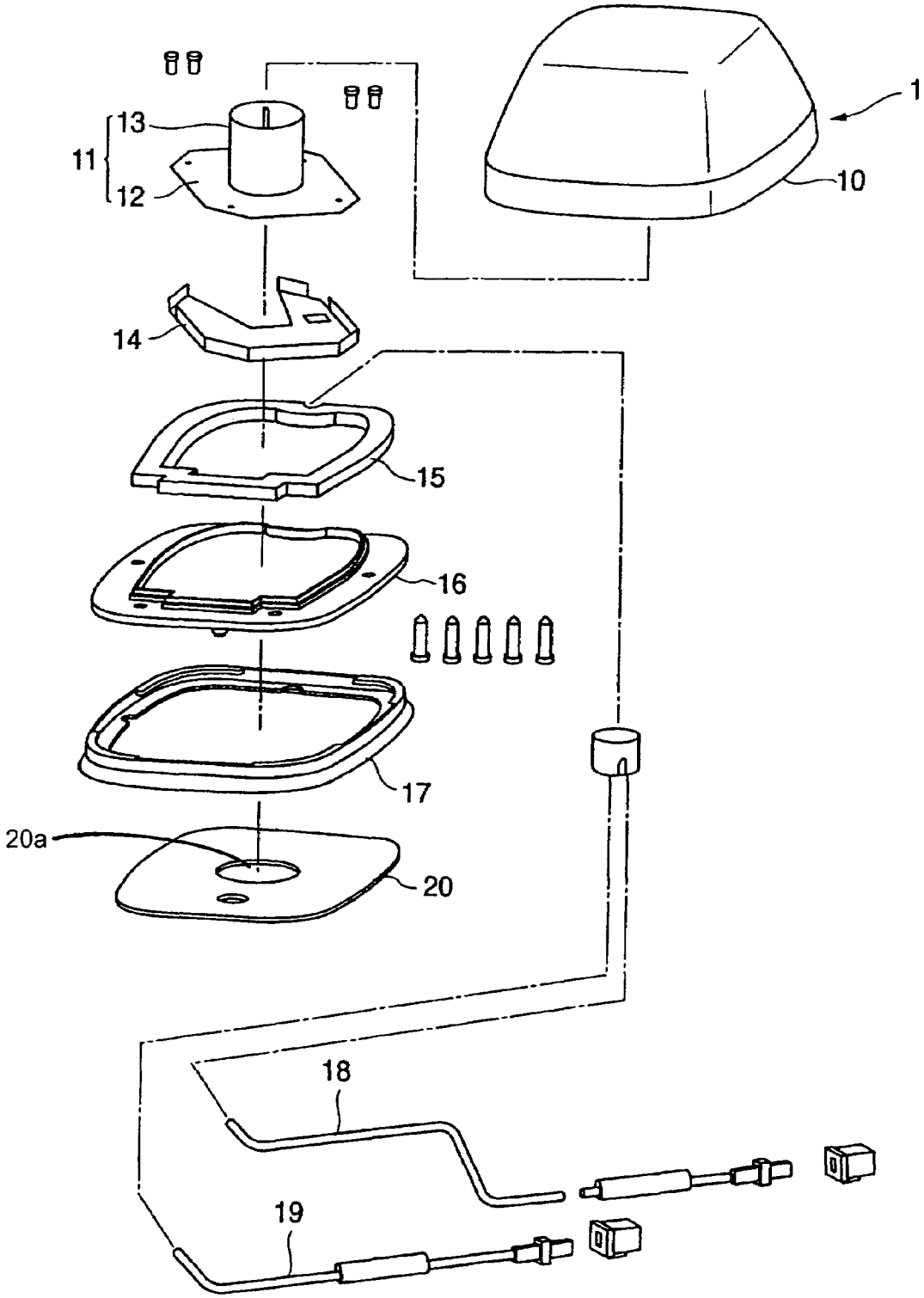
FIG. 1 is an exploded perspective view of a satellite radio reception antenna.

A satellite radio reception antenna 1, as shown in FIG. 1, has a cover member 10 of which the whole shape is nearly trapezoid. The cover member 10 is formed by injection molding a resin material having the desired atmospheric corrosion resistance and waterproofing, and the member 10 has inner space which houses each part of the satellite radio reception antenna 1. Further, the cover member 10, of which one surface is opened, is formed in the shape of a bowl. Further, by applying a color sheet printing onto an outer surface of the cover member 10, the color of antenna appearance can be changed variously, so that the user can select an antenna according to color of a car body.

In the inner space of the cover member 10, an antenna module 11 for receiving radio waves sent from a satellite is housed. The antenna module 11 comprises a base board 12 and a reception antenna unit 13 attached onto the base board 12. The reception antenna unit 13 is constituted by a composite antenna comprising a loop antenna for receiving, for example, a satellite wave and a pole antenna for receiving an earth wave. Further, on a rear surface of the base board 12 (on an opposite side to the surface on which the reception antenna unit 13 is attached), a shield case 14 that houses a peripheral circuit of the reception antenna unit 13 is set.

Further, on the opened surface of the bottom of the cover member 10, a bottom cover 16 is arranged through a rubber packing 15. This bottom cover 16 closes the bottom surface of the cover member 10. Further, around the bottom cover 16, a rubber gasket 17 is fitted thereby to block a gap between the cover member 10 that is a top cover and the bottom cover 16 and secure waterproofing.

In the thus constructed satellite radio reception antenna 1, coaxial cables 18 and 19 for taking out output from the reception antenna unit 13 are provided, and these cables are connected to the predetermined portions, for example, a satellite radio receiver and a metal plate that becomes a GND plate that are set in a vehicle, whereby reception of satellite radio can be performed.

The above satellite radio reception antenna 1 is attached onto the roof or trunk of the vehicle. At this time, it is fixed to the roof or trunk usually with a bolt and a nut. If the roof or trunk is made of plastic, it cannot correspond to the bolt tightening power, which causes breakage.

Therefore, in the invention, firstly, with double-sided tape, the satellite radio reception antenna 1 is fixed. Namely, as shown in FIG. 1, between the bottom cover 16 and the roof or trunk, a double-sided tape 20 is interposed to fix the satellite radio reception antenna 1 by its adhesive strength.

The double-sided tape 20 is cut corresponding to the shape of the bottom cover 16, thereby to adhesively bond and fix almost the whole bottom surface of the bottom cover 16. Further, in the double-sided tape 20, a hole part 20*a* corresponding to a hole for pulling out the coaxial cables 18 and 19 is formed, and from this hole part 20*a*, the coaxial cables 18 and 19 can be pulled into the vehicle.

By adhesive bonding and fixing the satellite radio reception antenna 1 with the both-sided tape 20, the tightening power is not applied to the roof or trunk, and even the plastic roof or trunk is not broken, but the antenna 1 is fixed stably and surely. Further, by interposing the donut-shaped both-sided tape 20 in which the hole part 20*a* is formed, the gap between the satellite radio reception antenna 1 and the vehicle (roof or trunk) is compensated completely, and a waterproof function is also secured, so that the antenna 1 is attached with high reliability.

The thus constructed satellite radio reception antenna 1, in case that an antenna element built in the reception antenna unit 13 is an antenna element having GND dependency, such as a patch antenna, a loop antenna, or the like, must utilize a roof or trunk composed of a metal plate as a ground plate to ground. However, in case that the roof or trunk is made of plastic, the ground can not be obtained.

Therefore, in the invention, corresponding to a setting position of the satellite radio reception antenna 1, on a back surface side of a plastic attachment part such as a roof or a trunk, a metal sheet is provided, and this sheet is utilized as the ground plate.

Figure 2:
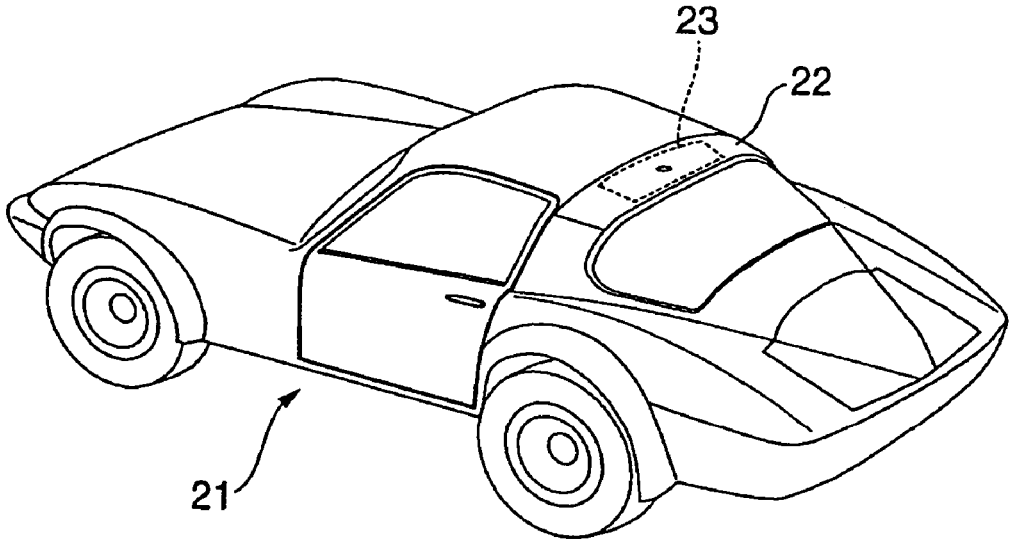
FIG. 2 is a perspective view showing a setting state of a metal sheet in case that a roof of a vehicle is used as an attachment part.

FIG. 2 shows an example of a vehicle on which the satellite radio reception antenna 1 is set. In this example, on a plastic roof 22 of a vehicle 21, the satellite radio reception antenna 1 is set. In this case, centered at the satellite radio reception antenna 1 on the roof 22, a metal sheet 23 that is larger in area than the bottom surface of the satellite radio reception antenna 1 is arranged on a rear surface side of the roof 22. The metal sheet 23 may be bonded, for example, with adhesive, or the circumference of the metal sheet 23 may be fixed with an adhesive tape to be attached.

Then, the metal sheet 23 is connected to a not-shown ground terminal. Hereby, also in the plastic attachment part, GND can be provided, so that ground of the reception antenna unit 13 can be obtained.

As described above, by providing the metal sheet 23 on the vehicle side, one equal to the reception antenna mounted on the metal roof as the reception antenna unit 13 can be used. In result, it is not necessary to provide a progressive wave type (helical type) or a self ground type reception antenna unit, and it is possible to provide the cheap antenna structure in which the height and the area are suppressed.

What is claimed is:

1. An antenna unit, comprising:

an antenna module, adapted to receive a radio wave;

a shield case attached to the antenna module;

an antenna case, comprising:

a bottom case attached to an attachment part which is made of resin; and a top case coupled to the bottom case so as to define an inner space to accommodate the antenna module and the shield case therein; and a metal sheet provided in the vicinity of the attachment part.

2. The antenna unit as set forth in claim 1, wherein the attachment part is provided in a vehicle.

3. The antenna unit as set forth in claim 2, wherein the attachment part is a roof or a trunk of a vehicle.

4. An antenna unit, comprising:

an antenna module, adaptedt to receive a radio, wave;

a shield case attached to the antenna module; and an antenna case, defining an inner space to accommodate the antenna module therein, wherein, an attachment part of an object to which the antenna unit is attached is made of a resin;

a metal sheet is provided with the attachment part;

the metal sheet is provided on a back surface side of the attachment part; and the antenna unit is adhesive bonded and fixed on a front surface side of the attachment part correspondingly to an arramgement position of the metal sheet.

5. An antenna units comprising:

an antenna module, adapted to receive a radio wave;

a shield case attached to the antenna module; and an antenna case, defining an inner space to accommodate the antenna module therein, wherein, an attachment part of an object to which the antenna unit is attached is made of a resin;

a metal sheet is provided with the attachment part; and the antenna unit is fixed to the attachment part by a double-sided tape.

* * * * *